US007117938B2

(12) United States Patent
Hamilton et al.

(10) Patent No.: US 7,117,938 B2
(45) Date of Patent: Oct. 10, 2006

(54) DRILL PIPE CONNECTING AND DISCONNECTING APPARATUS

(75) Inventors: William R. Hamilton, Conroe, TX (US); David Curtis Fletcher, Houston, TX (US); Donald D. Rae, Willis, TX (US)

(73) Assignee: Gray EOT, Inc., Willis, TX (US)

( * ) Notice: Subject to any disclaimer, the term of this patent is extended or adjusted under 35 U.S.C. 154(b) by 170 days.

(21) Appl. No.: 10/449,301

(22) Filed: May 30, 2003

(65) Prior Publication Data

US 2003/0221871 A1 Dec. 4, 2003

Related U.S. Application Data

(60) Provisional application No. 60/384,195, filed on May 30, 2002.

(51) Int. Cl.
*E21B 19/16* (2006.01)

(52) U.S. Cl. ..... 166/77.53; 81/57.16; 81/57.24; 166/77.4; 175/85

(58) Field of Classification Search ..... 166/77.53, 166/77.4, 77.51; 81/57.16, 57.25, 57.24, 81/57.34, 57.35, 57.4; 175/85
See application file for complete search history.

(56) References Cited

U.S. PATENT DOCUMENTS

| | | | | | |
|---|---|---|---|---|---|
| 3,096,075 | A | * | 7/1963 | Brown | 254/29 R |
| 3,722,603 | A | * | 3/1973 | Brown | 173/159 |
| 4,023,449 | A | | 5/1977 | Boyadjieff | 81/57.16 |
| 4,128,135 | A | | 12/1978 | Mitchhart et al. | 175/52 |
| 4,200,010 | A | | 4/1980 | Hewitt | 81/57.16 |
| 4,348,920 | A | * | 9/1982 | Boyadjieff | 81/57.25 |
| 4,567,952 | A | * | 2/1986 | Lemaire et al. | 173/164 |
| 4,649,777 | A | * | 3/1987 | Buck | 81/57.19 |
| 4,765,401 | A | | 8/1988 | Boyadjieff | 166/77.5 |
| 5,271,298 | A | | 12/1993 | Gazel-Anthoine | 81/57.16 |
| 5,520,072 | A | | 5/1996 | Perry | 81/57.16 |
| 5,660,087 | A | | 8/1997 | Rae | 81/57.2 |
| 6,082,225 | A | * | 7/2000 | Richardson | 81/57.16 |
| 6,138,776 | A | * | 10/2000 | Hart et al. | 175/85 |
| 6,142,041 | A | | 11/2000 | Buck | 81/57.35 |
| 6,206,096 | B1 | | 3/2001 | Belik | |

(Continued)

OTHER PUBLICATIONS

Blohm+Voss Type PSA 150 air-operated power slip brochure (2 pgs).

(Continued)

*Primary Examiner*—Hoang Dang
(74) *Attorney, Agent, or Firm*—Gary L. Bush; Andrews Kurth LLP

(57) ABSTRACT

Drilling rig apparatus for connecting and disconnecting well pipe at a drilling rig. A remotely controlled power wrench assembly is mounted on a remotely controlled lifting mechanism attached to a base spaced about the well axis on the rig floor. The wrench assembly includes upper and lower wrenches carried by the lifting mechanism. The wrench assembly includes a lower wrench for gripping a lower box coupling of a drill pipe section at the well center. An upper wrench is provided for torquing and spinning an upper pin coupling into or out of threaded engagement with the lower box coupling. A manipulator is pivotably carried on a rod supported from the wrench assembly. The manipulator captures a drill pipe section and transfers the drill pipe section between the well axis and a position at the side of the wrench assembly. A slot is provided between frame members of the base for placement of a power slip manipulator for setting and releasing slips in the rotary table.

13 Claims, 13 Drawing Sheets

U.S. PATENT DOCUMENTS

| | | | | |
|---|---|---|---|---|
| 6,318,214 | B1 | 11/2001 | Buck | 81/57.35 |
| 6,360,633 | B1 | 3/2002 | Pietras | 81/57.34 |
| 6,374,925 | B1 | 4/2002 | Elkins et al. | 175/25 |
| 6,386,284 | B1 * | 5/2002 | Buck et al. | 166/77.53 |
| 6,443,241 | B1 | 9/2002 | Juhasz et al. | 175/52 |
| 6,745,646 | B1 * | 6/2004 | Pietras et al. | 81/57.34 |
| 6,793,021 | B1 * | 9/2004 | Fanguy | 166/380 |
| 2002/0159839 | A1 | 10/2002 | Frijns et al. | |

OTHER PUBLICATIONS

Hitec Iron Roughneck brochure (2 pgs.).
JT Oilfield Mfg. Co. Inc. Iron Roughneck brochure (2 pgs.).
Varco Systems Iron Roughneck brochure (1 pg.).

* cited by examiner 20
18
20
18
44R
50BR
46R
48R
49R
61
62U
72B
70B
62U
52U
88
60
69R
66B
88
59
87B
61
72
3B
87F
52B
49R
50B
48L
20
18
18
20

FIG. 10
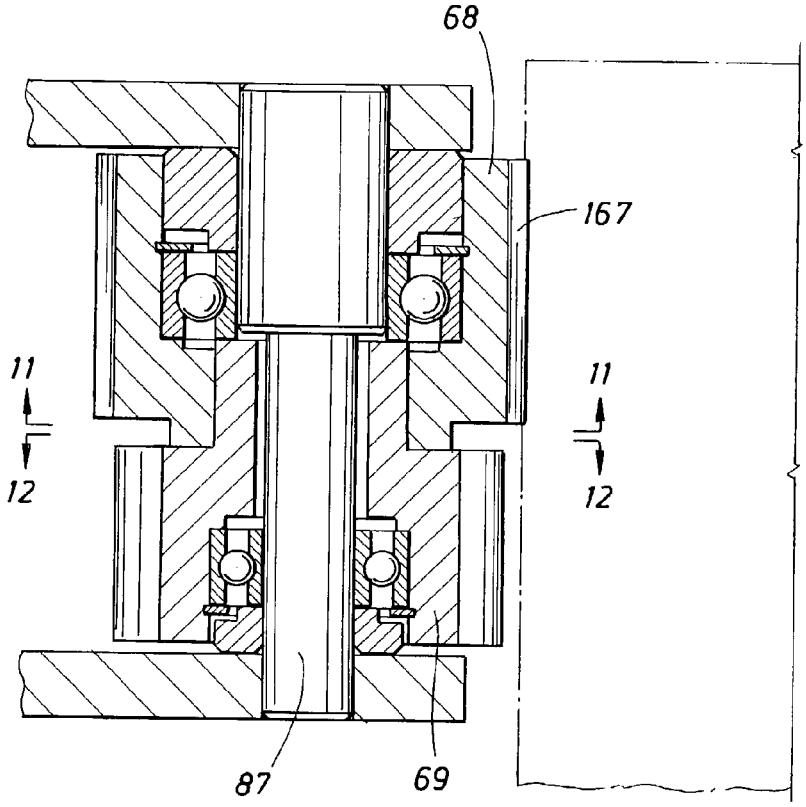
FIG. 11
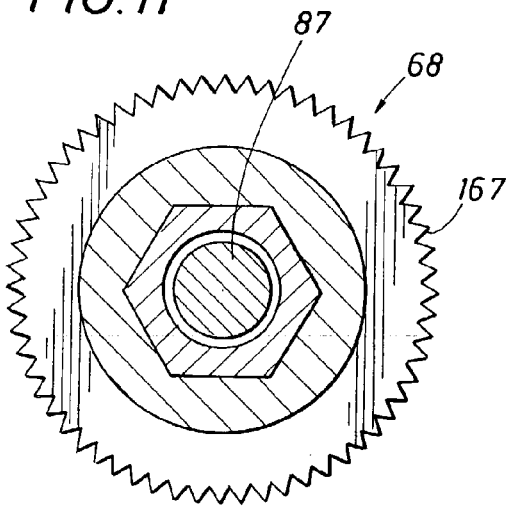
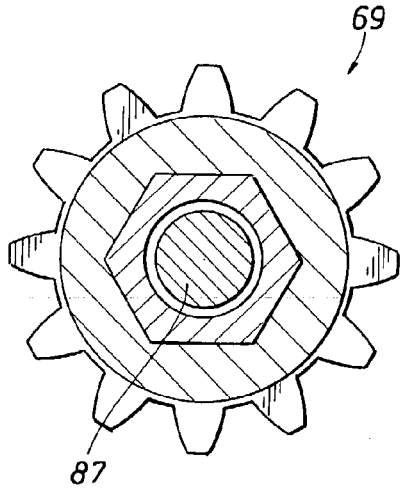
FIG. 12

DRILL PIPE CONNECTING AND DISCONNECTING APPARATUS

CROSS-REFERENCE TO RELATED APPLICATION

This non-provisional patent application is based upon provisional patent application 60/384,195 filed on May 30, 2002, the priority date of which is claimed.

BACKGROUND OF THE INVENTION

1) Field of the Invention

This invention relates generally to rotary drilling apparatus for oil and gas wells and in particular to apparatus for remotely controlling spinning and torquing operations for drill pipe joints or sections of drill pipe joints while going into a hole (connecting joints) or coming out of a hole (disconnecting joints) with rotary table/slip equipment of a drilling rig.

In particular, this invention relates to an assembly of three devices for the drilling rig platform: a remotely controlled powered slip for supporting a drill string in the well, a remotely controlled powered wrench assembly for spinning and torquing operations for coupling or decoupling a drill pipe point to a drill pipe joint which is supported by slips at the rotary table, and a remotely controlled powered manipulator arm for centering or swinging away an additional drill pipe joint or section with or from an existing joint in the powered wrench assembly.

2) Description of the Prior Art

Oil and gas well drilling operations generally employ a string of drill pipe joints or sections with a drill collar and drill bit connected at the bottom end of the string for boring through earth formations while forming a bore hole. The drill string is conventionally rotated by connecting a kelly at the top of the drill string and turning the kelly by a rotary drive located on or beneath the rig floor. Top drive systems are also used. In a rotary table/slip system, the kelly and the drill string transmit the rotary force to the drill bit. One or more drill collars located near the bottom of the drill string provide weight on the bit.

As the bore hole gets deeper, an additional drill pipe section must be added to the string already in the well. To do so, the drill string is lifted by the rig until the top-most drill pipe section extends above the rig floor. Slips are set at the rotary table to prevent the drill string from sinking into the bore hole. The kelly is removed from the upward facing box threads of the top-most drill pipe section. The kelly is then pulled over to a new drill pipe section waiting in a "mouse hole" and has its pin threads made up with the box threads of the new section. Next the kelly and new drill pipe section are moved over and centered into position above the upwardly facing box end of drill string, with a pin end of the new drill pipe section pointing down. The pin of the new section is then stabbed into the upwardly facing box of the drill string. The threaded connection is made up between the box end of the pipe section extending above the rig floor and the pin end of the new pipe section. The box end of the pipe section is gripped by tongs while the pin end is tightly screwed or "spun" into the box. Then additional torque is applied between the pin and box until the threaded connection is properly made up. The drill string with the kelly attached to the top is lowered into the borehole. Drilling continues by turning the kelly with the rotary drive at the top of the drill floor.

Typical drilling operations call for a worker (a "roughneck") on the rig floor to perform spinning operations with a drill pipe spinner and to perform torquing with tongs on the box and pin upset portions of drill pipe sections to "torque up" or tighten the threaded connection to manufacturer tightness specification. Prior art tongs have included hydraulically powered tongs or manual tongs using wire rope and cathead. Spinners are predominately air or hydraulically powered drill pipe spinning devices. Such tongs and spinners require manual manipulation of the equipment and drill pipe at the drill rig platform floor. Operating the tongs and pipes is inherently dangerous, because a rig employee or "roughneck" must physically handle the powerful equipment near the drill pipe. Accidents have been common with loss of fingers, hands, etc.

When a drill string is being taken out of the bore hole in order to replace a drill bit at the bottom end of the string, a reverse procedure is followed; the threaded connection is loosened or "broke out" with tongs and spun out with a drill pipe spinner.

The prior procedures and equipment described above are inherently dangerous to roughnecks working to make-up and break apart and disconnect drill pipe connections. Not only is the roughneck beneath the drill pipe section as it swings from the side of the hole for make up or disconnection operations, he must also handle the slips, the spinner and the tongs many times when the string is being made up while reentering the well or removing the string from the well.

Powered equipment such as power tongs and spinners have been provided with limited remote control in a tool called the "Iron Roughneck". One description of an Iron Roughneck machine is provided in U.S. Pat. No. 4,348,920. That patent shows a power driven tool for making and breaking threaded connections in a well pipe that is moveable between a central position of alignment with the well axis and a retracted or inactive position offset at a side of the well axis. The Iron Roughneck tool of the '920 patent includes a carriage which rolls horizontally from the side of the well axis between inactive and active positions on spaced tracks. A pipe contacting mechanism is arranged to move up and down with respect to the carriage and includes an upper well pipe spinner and a lower torque wrench assembly. The Iron Roughneck of the '920 patent includes an arrangement which provides pivotable movement to an inclined position for alignment of the kelly with a new drill pipe section in a mousehole.

The Iron Roughneck has solved some of the safety problems of manual tongs and spinners, yet problems still exist. The first is that horizontal movement on the rig floor takes up limited horizontal space. Furthermore, manual centering of a new pipe joint with a pipe joint in the well may be required. Manual placing of slips in the rotary table to support the drill string in the well may also be required. All such manual operations at the well center create the opportunity for accidents to well operating personnel.

3) Identification of Objects of the Invention

A primary object of the invention is to provide an assembly of remotely controlled equipment for operations at the rig floor when adding or removing tool joints to or from a drill string or including a remotely controlled powered slips tool, a remotely controlled tool joint connecting and disconnecting tool, and a remotely controlled manipulator arm for centering an additional tool joint with an existing tool joint in the drill string.

Another object of the invention is to provide a remotely controlled tool joint connecting and disconnecting tool which requires no horizontal movement along the drilling platform floor for saving valuable space on the platform floor.

Another object of the invention is to provide a remotely controlled hydraulically powered drill pipe connecting and disconnecting tool which is installed without being horizontally moveable with respect to the well axis and requires no manual manipulation of equipment at the well enter when tool joints are being connected or disconnected.

SUMMARY

The objects identified above, along with other features and advantages of the invention are incorporated in an assembly of three tools: a remotely controlled powered slip at the rotary table; a remotely controlled powered wrench assembly for connecting and disconnecting tool joints at the well axis, and a remotely controlled manipulator arm secured to the wrench assembly for gripping, rotating and centering an additional drill pipe section to a box coupling of a tool joint in the wrench assembly.

The remotely controlled powered wrench includes a base placed on the rig floor around the well opening above the rotary table of the drilling rig. Four rod/hydraulic cylinders extend vertically from the bore. The base has a cut out portion to accept a powered slip machine for manipulation of slips in the rotary table. Upper and lower wrench assemblies are mounted on a housing which is secured to the hydraulic cylinders. Providing hydraulic power to the cylinders by remote control from a control panel causes the housing and the wrench assemblies to be raised or lowered until the lower wrench is aligned with the box coupling of the drill string, and the upper wrench assembly is aligned with a drill pipe joint pin coupling being either connected or disconnected.

The lower wrench assembly includes three hydraulically powered jaws for gripping the box coupling. The upper wrench assembly includes a housing with a central generally rectangular or square-shaped cavity through which the well axis passes. Powered rollers are moveable between two opposite sides of the square-shaped cavity and powered between a closed or inner position for contact with the drill pipe male coupling and an open or outer position out of the cavity. The upper drill pipe joint pin coupling is spun by the powered rollers into or out of the connection while the female coupling of the drill string is gripped by the lower wrench.

The male coupling of the upper drill pipe joint is torqued in or out of tight screw engagement with the female coupling by oppositely facing jaws, powered by a single remotely controlled hydraulic cylinder, with the jaws moving into or out of the square-shaped cavity from the two directions which are perpendicular from that of the spin rollers. After the pin coupling is gripped by the gripping jaws, torquing cylinders, mounted on the upper wrench frame and tool housing, turn the upper wrench by torquing the pin coupling to tighten or loosen the connection.

The manipulator of the assembly is mounted for rotation on a vertical pole or rod on top of the housing of the wrench assembly. The manipulator has hydraulic powered arm and hand mechanisms for gripping a drill pipe section to the side of the well axis of the powered wrench and swinging the drill pipe section into alignment with the well axis so that the pin coupling of the pipe section to be added is in alignment with the box coupling gripped by the lower wrench. The manipulator can also move a drill pipe joint or section from the well axis to the side.

BRIEF DESCRIPTION OF THE DRAWINGS

The above features and objects of the invention are illustrated in the accompanying drawings and referred to in the detailed description which follows, in which:

FIG. 10 is a section view taken along lines 10—10 of FIG. 5 showing a spin roller above and a gear for that spin roller below;

FIG. 11 is a upward view of the spin roller taken along lines 11—11 of FIG. 10;

FIG. 12 is a downward view of the gear for the spin roller taken along lines 12—12 of FIG. 10;

DESCRIPTION OF PREFERRED EMBODIMENT OF THE INVENTION

Figure 1:
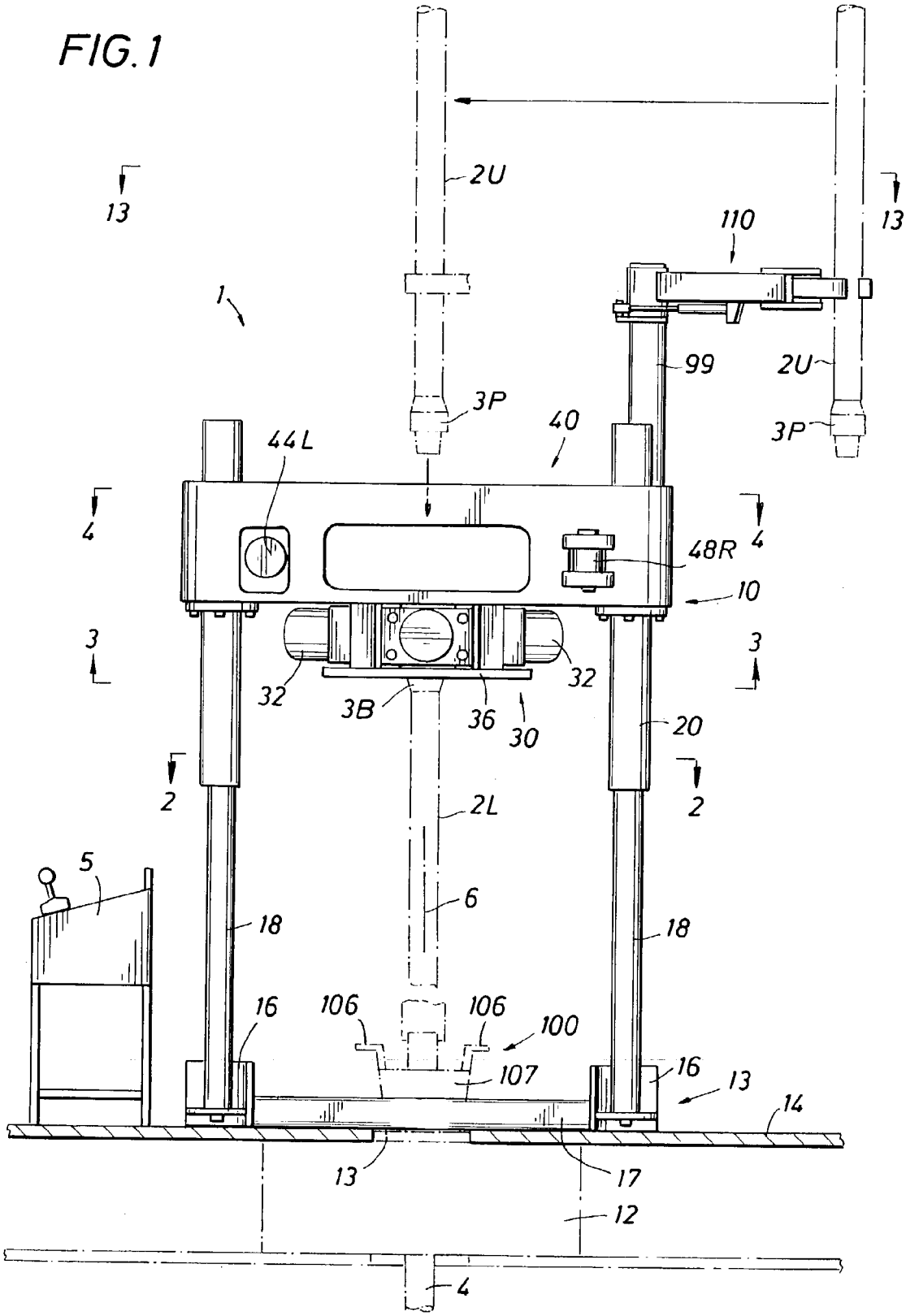
FIG. 1 is a side view of an automated connecting and disconnecting system for a drilling rig including remotely controlled-powered slips at the rotary table, a remotely controlled drill pipe connecting and disconnecting assembly (powered wrench), and a drill pipe manipulator.

The description which follows refers to the appended drawings and by reference numbers to specific parts and assemblies. The list which follows correlates reference numbers with part names.

| | |
|---|---|
| 1 | Remotely controlled assembly for connecting and disconnecting drill pipe |
| 2L | Lower drill pipe section |
| 2U | Upper drill pipe section |
| 3B | Box coupling or upset |
| 3P | Pin coupling or upset |
| 4 | Drill string |
| 5 | Control panel |
| 6 | Well centerline |
| 10 | Drill pipe connecting and disconnecting tool (Powered Wrenches) |
| 12 | Rotary table |
| 13 | Opening to rotary table |
| 14 | Rig floor |
| 16 | Base foot |
| 17 | Base structural member |
| 17A, B | Base structural members for slot for powered slip assembly |
| 18 | Vertical rods |
| 20 | Hydraulic cylinder on vertical rods |
| 30 | Lower wrench |
| 32 | Piston for lower wrench |
| 34 | Jaw for lower wrench |
| 36 | Bottom plate for lower wrench |
| 40 | Wrench assembly mounted on hydraulic cylinder |
| 42 | Frame |
| 42U | Top frame member |
| 42B | Bottom frame member |
| 42S | Side frame member |
| 44L | Left torquing cylinder for upper wrench |
| 44 | Flanges on cylinder |
| 45L, 45R | Torque cylinder |
| 46 | Bolts |
| 47 L, 47R | Rods |
| 48R | Pin for right torquing rod for upper wrench |
| 48L, 48R | Pivot pins |
| 49L, 49R | Pivot brackets |
| 50UL, 50BL, 50UR, 50BR | Trunnions |
| 51UL, 51RL, 51UR, 51BR | Left and right coupling member pairs |
| 52U, 52B | Upper and bottom housing plates |
| 60 | Spin cylinder |
| 61 | Pin |
| 62U, 62B | Upper and bottom plates |
| 63 | Upper bracket |
| 64 | Motor |
| 66U, 66B | Upper and bottom side plates of upper wrench |
| 68 | Spin roller |
| 68L, 68R | Left and right spin rollers |
| 70U, 70B | Upper and bottom rods |
| 72U, 72B | Upper and bottom cylinders |
| 80 | Upper gripping piston |
| 82 | Gripping jaws |
| 83 | Contact pins |
| 87 B, 87F | Back and front jaw blocks |
| 88 | Vertical rods in jaw blocks |
| 89 | Oblong slots in housing members |
| 99 | Centering pole for manipulator |
| 100 | Power slip assembly |
| 101 | Arm manipulator |
| 102 | Hand of manipulator |

-continued

| | |
|---|---|
| 104 | Radial bearing |
| 105 | Pin |
| 106 | Slip handle (removeable) |
| 107 | Slips |
| 108 | Pins for power slip |
| 110 | Manipulator |
| 111 | Pin |
| 120 | Insert |
| 124 | Fingers of insert |
| 167 | Serrated teeth of spin roller |
| 202 | Slot for powered slip |
| 300 | Upper wrench |
| 302 | Central cavity |

The remotely controlled assembly 1 for connecting and disconnecting drill pipe is illustrated on a rig floor 14 of a drilling rig having a derrick (not shown) for lifting and lowering drill pipe sections as they are made up into a drill string for drilling an oil and gas well. The drilling rig includes a rotary table 12 through which the drill string passes. A kelly (not shown) at the top of the drill string is engaged by the rotary table which is turned by a draw works for turning the drill string (with a bit and associated tools) for forming a bore hole This arrangement of FIG. 1 can be used for tripping operations where drill pipe sections are taken out of the well or installed and run into the well. The drill string 4 is supported in the rotary table by slips 107, such that the box coupling 3B of the upper-most drill pipe section 2L is exposed and to which a drill pipe joint 2U (or sections screwed together) with its downwardly facing pin coupling 3P is to be connected or disconnected. Prior to removing the drill pipe string from the well, the drill string is lifted by derrick equipment and the kelly is removed from the top joint of drill pipe.

FIG. 1 shows assembly 1 including a remotely controlled powered slip assembly 100 installed at the rotary table 12 and with drill pipe connecting and disconnecting apparatus or powered wrenches 10 installed on hydraulically powered, remotely controlled cylinders 20 on vertically extending rods 18. A remotely controlled, hydraulically powered manipulator 110 is mounted on a centering pole 99 extending upwardly from the frame of upper wrench assembly 40. A control panel 5 provides levers for control valves for each of the remotely controlled devices.

Description of Base with Slot for Powered Slip Tool

Figure 2:
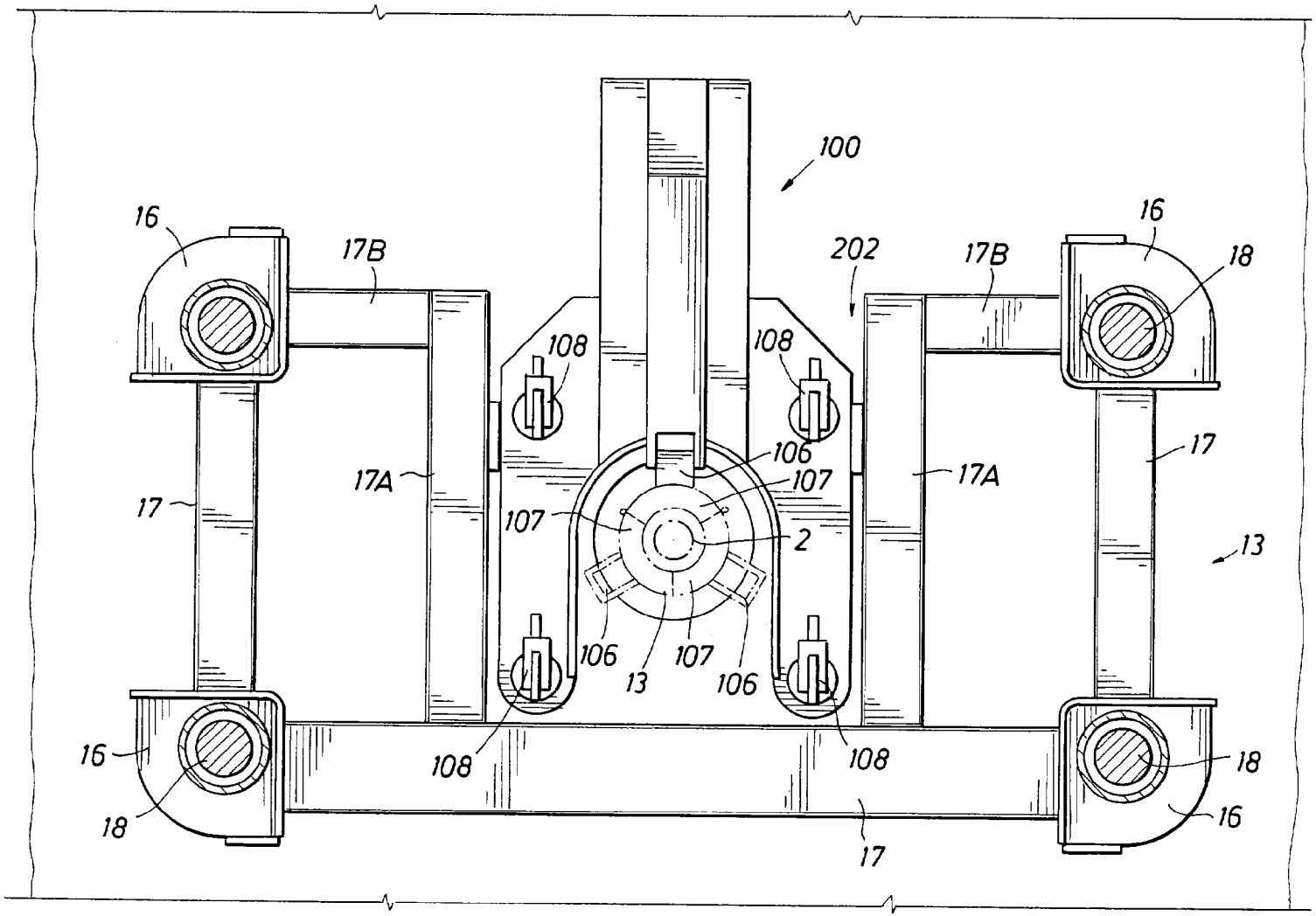
FIG. 2 is a downward, partially sectioned view taken along lines 2—2 of FIG. 1 which shows the bottom frame for the powered wrench with a slot in which a powered remotely controlled slip device is installed at the rotary table of a drilling rig.

FIG. 2 is a view looking downward along lines 1—1 of FIG. 1 and shows the base 13 of the assembly 1. The base includes four feet 16 laid out in a rectangular pattern for placement on the rig floor 14. Cross members 17 provide longitudinal and lateral support among the feet 16 as illustrated. Support members 17B and 17A are configured to provide a slot 202 for the remotely controlled power slip 100 which preferably is a Blohm & Voss Type PSA 150 air-operated power slip which is operated from the driller's console or control panel 5 of FIG. 1. The power slip 100 includes lifting arms which engage the slips 107 about the drill pipe 2 in the opening. Pins 108 of the power slip are placed in corresponding holes on the top of rotary table 12. The Blohm & Voss PSA 150 power slips accommodate standard rotary slips in the range of 2⅜" to 7" and enhances rig safety by eliminating personnel on the rig floor where slip manipulation is required.

Description of Lower Wrench

Figure 3:
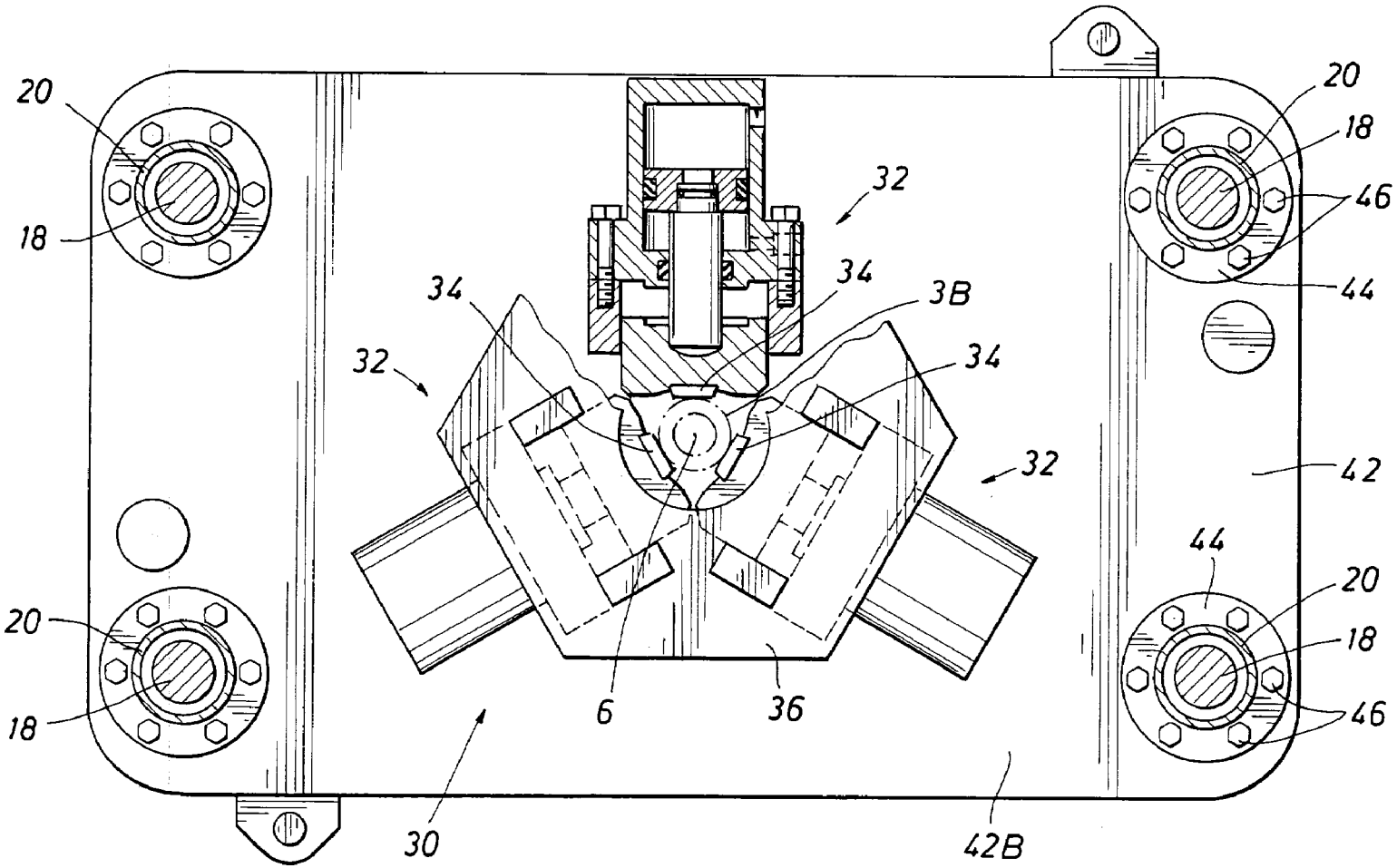
FIG. 3 is an upper view partially in section taken along lines 3—3 of FIG. 1 and shows three hydraulic pistons with gripping jaws of a lower wrench assembly for gripping the box end of a coupling of a drill pipe section after the powered wrench has been moved vertically to that position.
Figure 4:
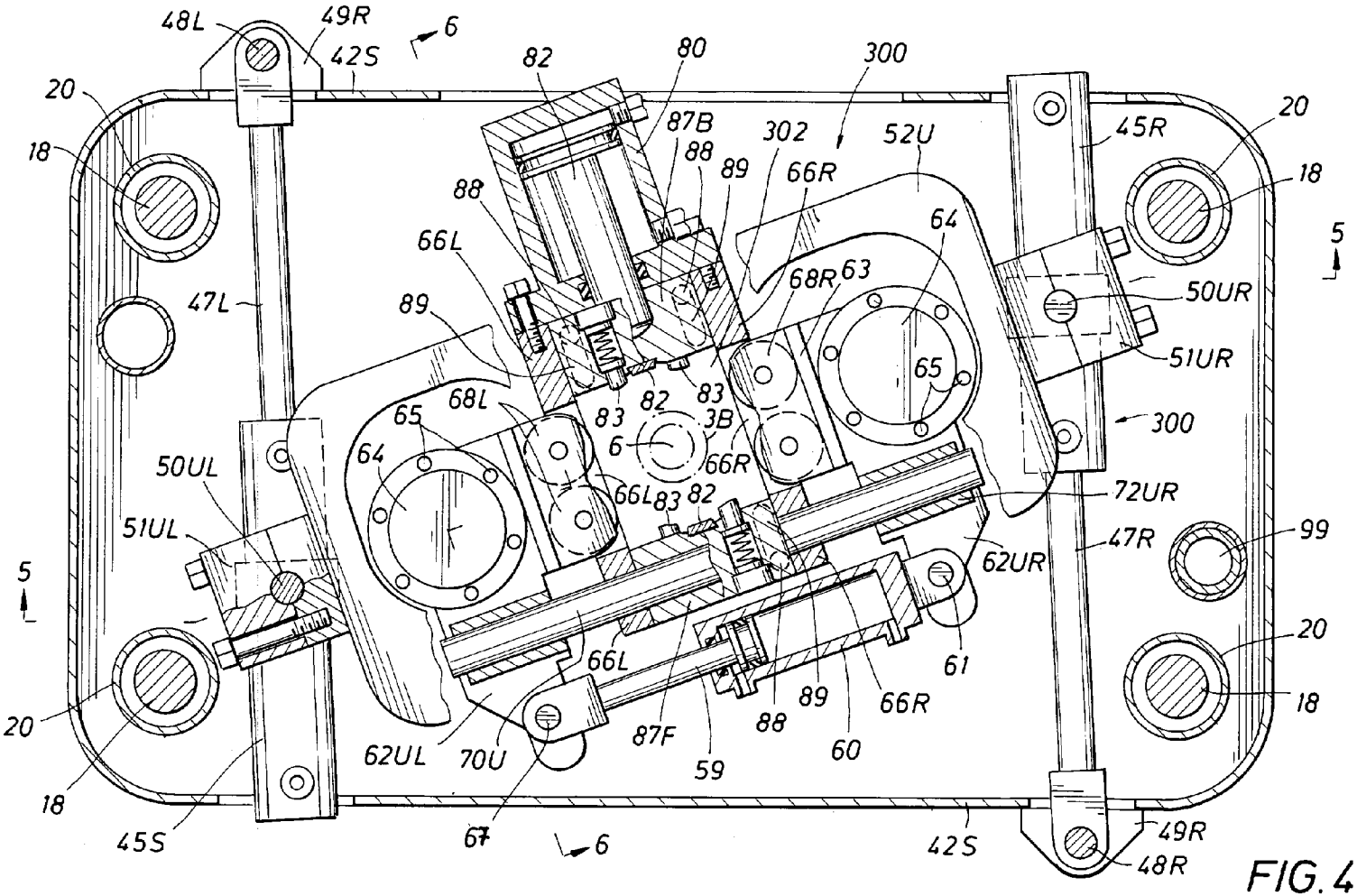
FIG. 4 is a downward view along lines 4—4 of FIG. 1, partially cut away and partially in section of the upper wrench which spins, grips and torques the pin coupling of a drill pipe section, with the upper wrench shown in an open position to allow the pin end coupling to be manipulated and centered with a box end coupling below captured by the lower wrench for threaded engagement thereto.
Figure 5:
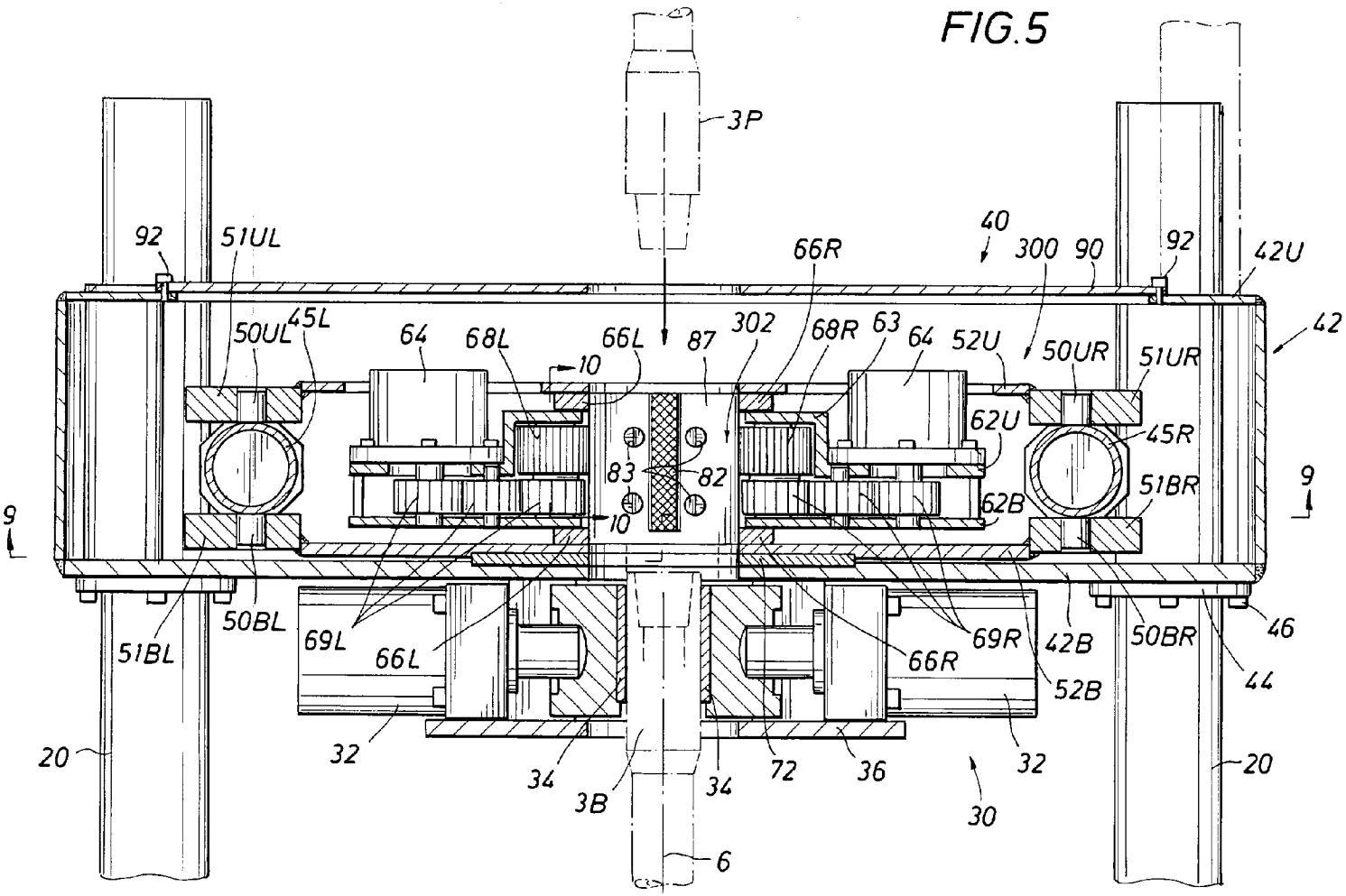
FIG. 5 is a longitudinal section view taken along lines 5—5 of FIG. 4 through the lower and upper wrenches, with the lower wrench closed about a box coupling of a lower drill pipe section and the upper wrench open prior to lowering of a pin coupling of a drill pipe section from above.

FIGS. 3, 4 and 5 illustrate the lower wrench 30 of the wrench assembly 40. FIG. 3 is a view taken along lines 3—3 of FIG. 1 and shows a bottom view of the lower wrench 30 below a bottom frame member 42B best seen in FIG. 5 which is a longitudinal section through the wrench assembly 40 as indicated in FIG. 4. As best seen in FIG. 5 the frame 42 of the wrench assembly 40 includes top and bottom frame members 42U, 42B through which hydraulic cylinders 20 extend and are attached thereto by flanges 44 secured to cylinder 20 as by welding and by securing the flanges 44 to frame member 42B by bolts 46.

As illustrated in FIGS. 3 and 5, the lower wrench 30 includes three remotely controlled hydraulic cylinders 32 spaced at 120 degrees apart between bottom plate 36 and bottom frame member 42B. Each piston has a jaw 34 which faces the wellhead axis 6. The pistons 32 are remotely controlled by the hydraulic circuit of FIG. 17 from control panel 5.

Figure 17:
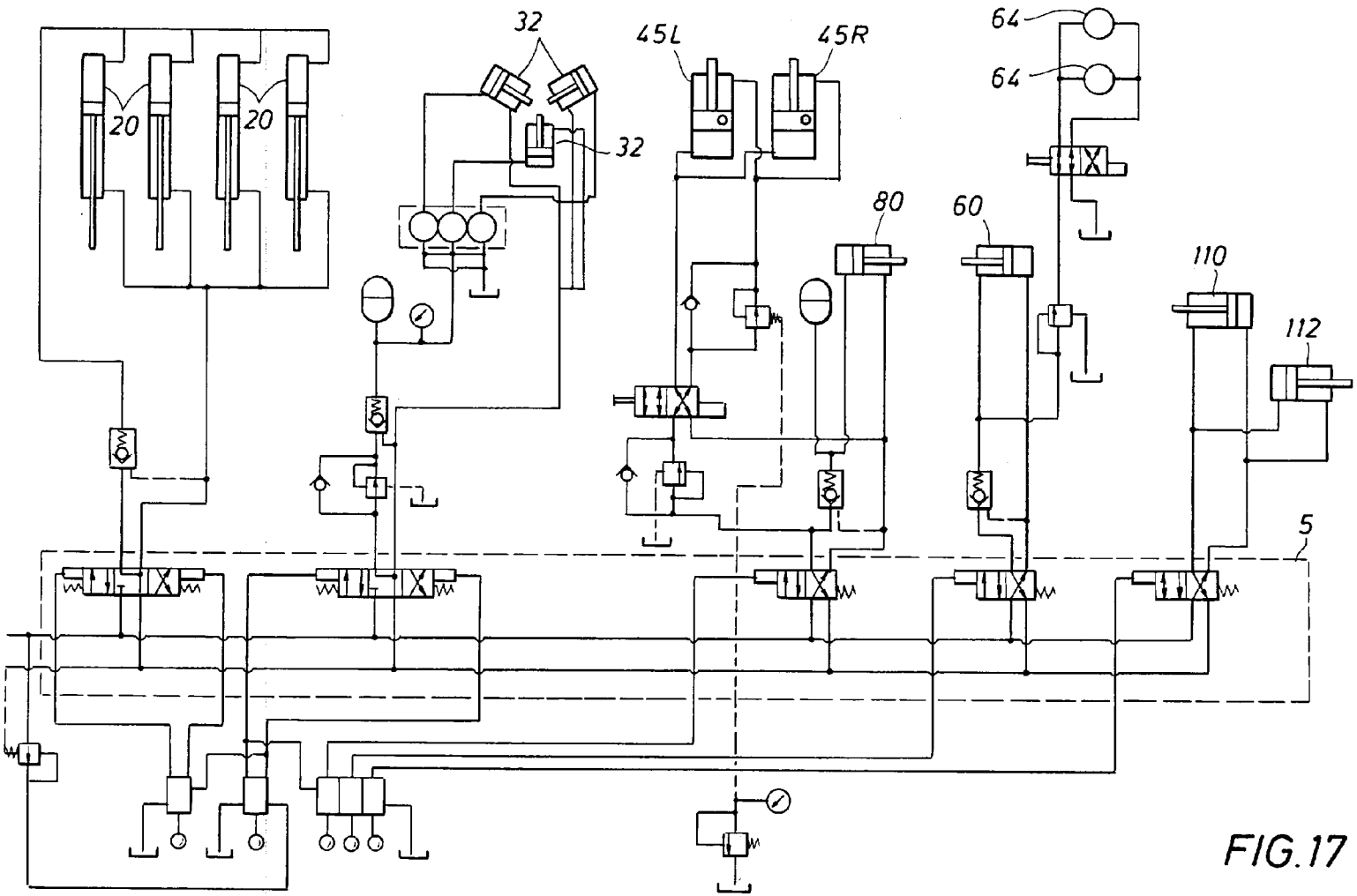
FIG. 17 shows hydraulic circuitry for controlling hydraulic and pneumatic controls of the power slip, vertical wrenches and manipulator arm of FIGS. 1–16.

The remotely controlled wrench assembly 40 is raised or lowered by operation of cylinders 20 via the hydraulic circuit of FIG. 17 from control panel 5 with the pistons 32 in a retracted position. When it is necessary to remove or add a drill pipe joint or stand of drill pipe joints (e.g., three joints screwed together) the assembly 40 is moved vertically so that lower wrench 30 is generally aligned with box coupling 3B. The pistons 32 are actuated so that jaws 34 grip tightly about box coupling 3B.

Description of Torquing Mechanism

Figure 6:
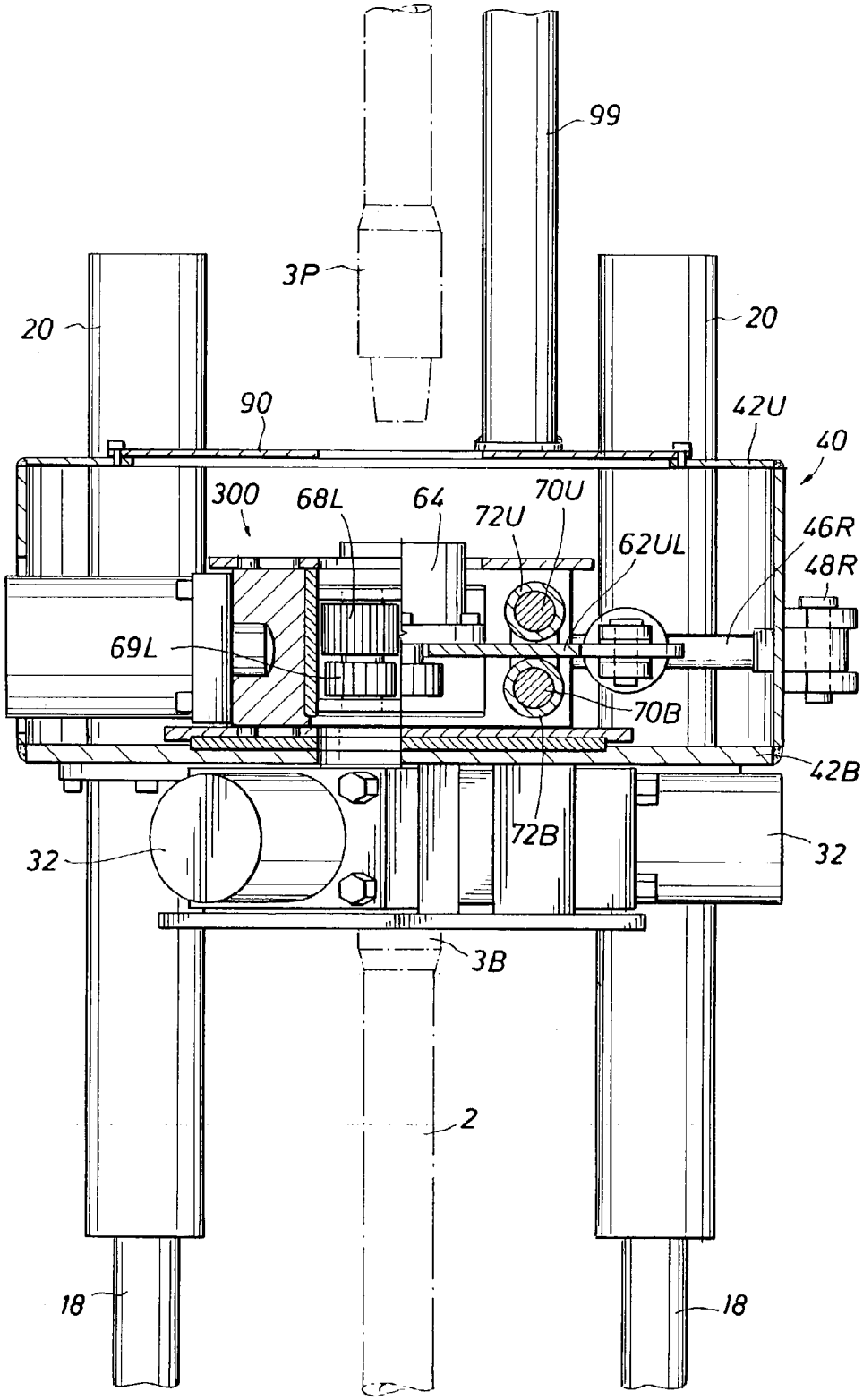
FIG. 6 is a side section view taken along lines 6—6 of FIG. 4 through the upper and lower wrenches.

Spinning and torquing operations are performed with upper wrench 300 shown in a top view (FIG. 4), longitudinal section view (FIG. 5) and in a lateral section view (FIG. 6). The upper wrench 300 includes a housing with top and bottom members 52U, 52B which are welded to left and right coupling member pairs, 51UL, 51BL and 51UR, 51BR. The coupling member pairs are supported by trunnions 50UL, 50BL and 50UR, 50BR, which are fastened to left and right remotely controlled torque cylinders 45L, 45R, respectively. As shown in FIG. 4, left torque cylinder 45L travels on rod 47L which is connected to housing side 42S via pivot pin 48L and pivot bracket 49L which is welded to back frame side 42S. Right torque cylinder 45R travels on rod 47R which is connected to housing side 42S via pivot pin 48R and pivot bracket 49R which is welded to front frame side 42S. When the torque cylinders are remotely actuated by the hydraulic circuit of FIG. 17, the cylinders 45L and 45R travel in opposite lateral directions as viewed form the top as in FIGS. 4, 7 and 8 causing the housing of upper wrench assembly 300 to torque clockwise or counterclockwise with respect to the frame 42 as the case may be about the well centerline 6.

As best seen in FIGS. 4 and 5, the upper and lower frame members 52U, 52B define a central cavity 302 which has a generally square longitudinal cross section centered about the well axis 6. The upper wrench 300 is constructed to move spin rollers 68L, 68R on opposite longitudinal sides of cavity 302 longitudinally into and out of cavity 302 as viewed form FIG. 4 (top view) and for FIG. 5 (longitudinal section view). The upper wrench 300 is also constructed to move gripping jaws 82 on opposite lateral sides of cavity 302 into and out of cavity 302 as viewed from FIG. 4 (top view).

Description of Mechanism for Moving Spin Rollers 68L, 68R Into and Out of Cavity 302

Figure 7:
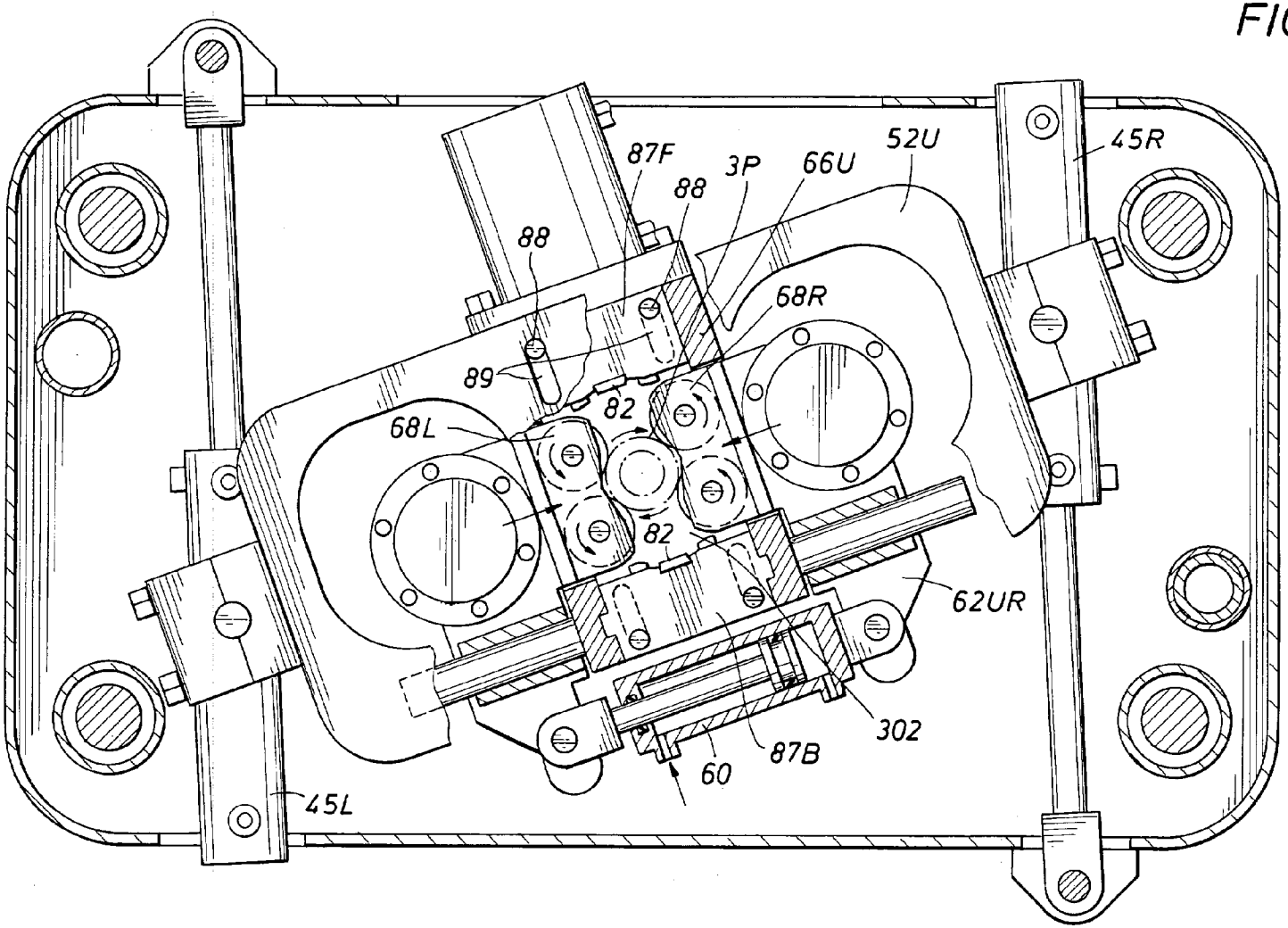
FIG. 7 is a downward view along lines 4—4 of FIG. 1 partially cutaway and partially in section of the upper wrench showing right and left sections of the upper wrench moved inwardly until spin rollers are engaging the pin collar of a drill pipe section for screwing the upper pin coupling into the lower pin coupling.

Referring to FIGS. 4 (top view), 5 (longitudinal cross section), and 6 (side cross section), the spin rollers 68L, 68R are driven from below by gears 69 mounted on vertical shafts between plates 62U, 62B. FIGS. 10, 11 and 12 illustrate the spin roller 68 construction having an outer serrated shape 167 for contacting pin coupling 3P. Referring to FIG. 5, the gears 69L, 69R, driven respectively from remotely controlled spin motors 64 have their shafts journaled between top and bottom plates 62U, 62B. The spin rollers 68L, 68R have their shafts journaled at their top end in an upper bracket 63. As shown in FIG. 5, bottom plate 62B and bracket 63 are arranged to slide longitudinally within an opening of side plates 66L and 66R. FIGS. 4 and 5 show the spin rollers 68L and 68R positioned outside cavity 302. FIG. 7 shows the spin rollers 68L and 68R moved longitudinally to an inner portion within cavity 302. The bracket 63 and plates 62U, 62B, are slidable longitudinally between an outer, "non-contact position" as in FIG. 4 and an inner "contacting position" as in FIG. 7, and are carried in the opening of side plates 66L and 66R. The bracket 63 and plates 62U, 62B move with the slide plates 66L, 66R when the slide plates, 66L, 66R slide laterally with respect to upper and bottom or "sandwich" plates 52U and 52B during upper wrench gripping operations. As discussed in more detail below, the slide plates 66L and 66R are guided by four pins 88 in each of blocks 87B, 87F moving in slots 89 of upper and bottom plates 52U, 52B.

FIGS. 4 and 6 illustrate the arrangement for forcing plates 62U and 62B longitudinally into and out of cavity 302 via the opening of slide plates 66L, 66R. The spin cylinder 60 is pinned at 61 to right side upper plate 62UR, while rod 59 on which cylinder 60 travels is pinned at 67 to left side upper plate 62UL. As seen in FIGS. 4, 5, and 6, sliding rods 70U, 70B are installed in upper and lower cylinders 72U, 72B which are affixed to upper plates 62UR, 62UL and are longitudinally aligned. When the remotely controlled cylinder 60 is operated from the hydraulic circuit of FIG. 17 as illustrated in FIG. 4, the upper plates 62UR, 62UL are pulled away from or out of cavity 302. By their connection to lower plates 62B, the entire spinning assembly is pulled out of the cavity 302. FIG. 7 shows that after the spin cylinder is operated in the opposite direction, upper plates 62UL and 62UR (and of course, lower plates 62BL, 62BR) are pushed inward into cavity 302 via the opening in plates 66L, 66R until spin rollers 68R, 68C engage the collar 3P with their serrated teeth 167 (See FIGS. 10, 11).

During spinning in and out of connection of pin coupling 3P (See FIG. 7), the upper drill pipe section 2 moves vertically downward as it spins in or vice versa when it spins out. The spin rollers 68L and 68R are constructed to have sufficient height and of a material to allow the pin coupling 3P to slip or pass vertically by the rollers 68L, 68R even while being driven into contact with box coupling 3B.

Description of Mechanism for Moving Gripping Jaws 82 Into or Out of Cavity 302

Figure 8:
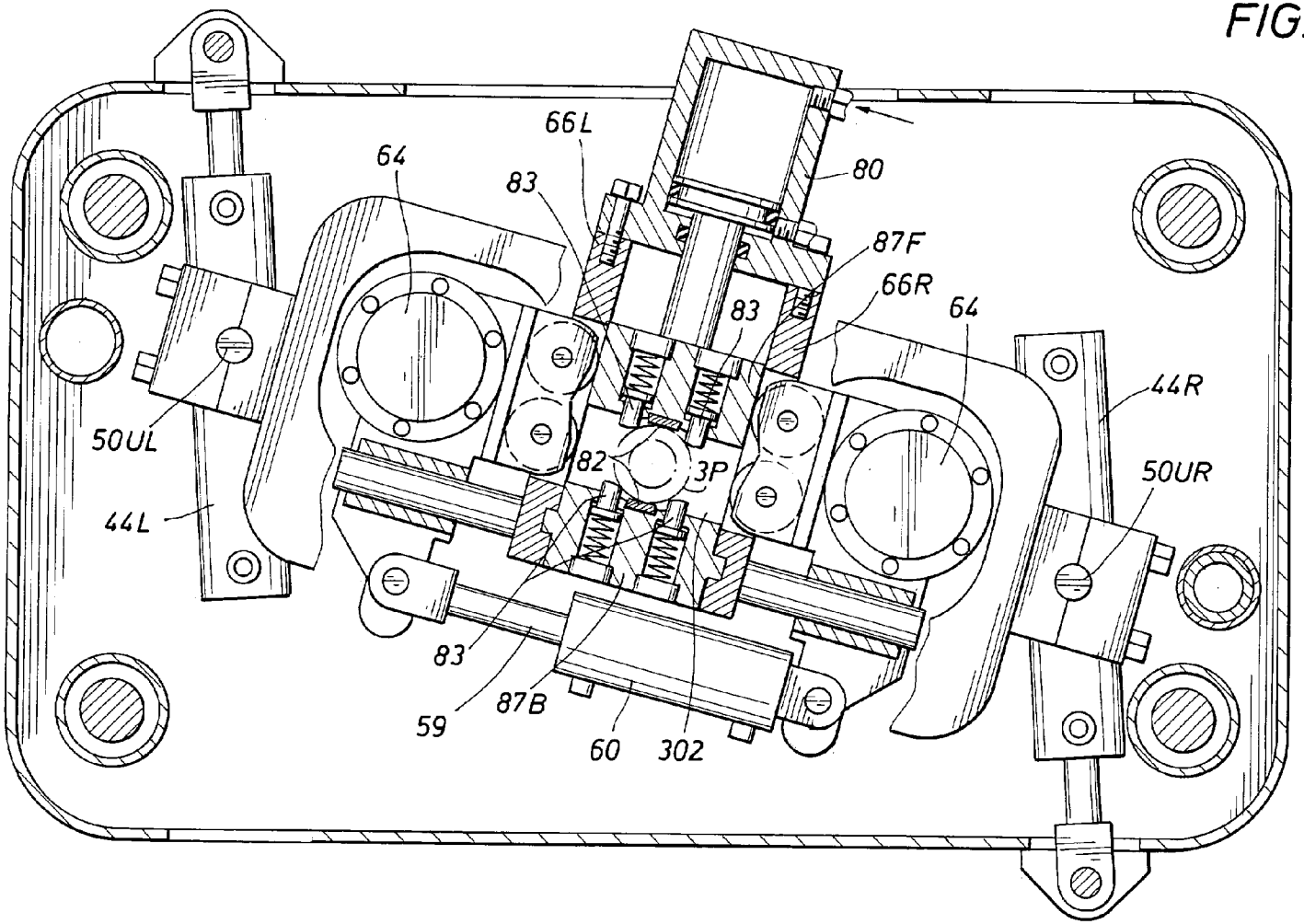
FIG. 8 is a downward view similar to FIG. 8, but shows the spin rollers moved outwardly from the pin collar, with the back and front jaws of the upper wrench gripping the pin collar and right and left torque cylinders operated to apply clockwise torque to the coupling.
Figure 9:
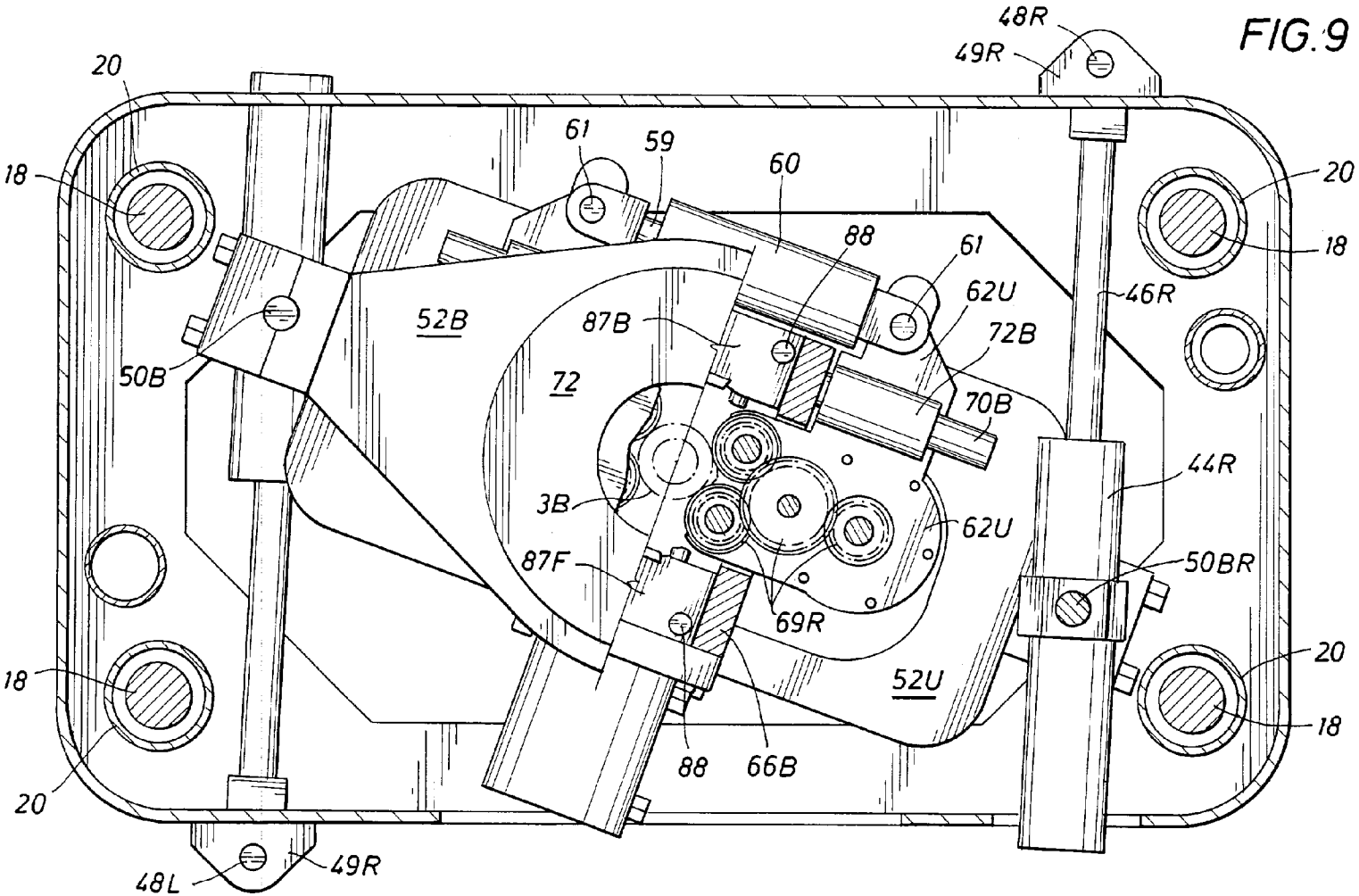
FIG. 9 is an upward view of the upper wrench taken along the lines 9—9 of FIG. 5 with the drawing on the left-hand side showing a mounting member and the bottom of a housing member, and the drawing on the right-hand side showing bottom ends of gears between a right hand side spin motor and spinning rollers that engage a drill pipe coupling.

FIG. 4 shows opposed jaw blocks 87B, 87F each of which has gripping jaws 82 installed in their face as best seen in FIG. 5. Spring loaded contact pins 83 are also provided in the faces of the jaw blocks 87B, 87F as illustrated in FIGS. 4 and 5. Jaw blocks 87B, 87F are installed radially inwardly and are laterally movable between side plates 66L, 66R. The jaw blocks 87B, 87F are free to move laterally (as seen in FIGS. 4 and 5) within side plates 66L, 66R into or out of cavity 302. Driving force on jaw blocks 87B, 87F is provided by upper gripping cylinder 80 having its piston rod 82 fastened to back jaw block 87B. As best seen in FIGS. 4, 7 and 9, blocks 87F, 87B have vertically extending rods 88 which are fitted within oblong slots 89 of upper housing members 52U, 52B. In the open or retracted position of jaw block 87F and 87B as shown in FIGS. 4 and 7, the rods 88 are positioned relative to frame members 52U, 52B such that the rods 88 are at the rear of the slot. When the piston 82 forces jaw 87F toward the center of cavity 302, the rods 88 in front jaw block 87F move toward the pipe coupling 3P guided by slots 89 until the pins 82 and jaw 82 contact the pin coupling 3P. The pins or rods 88 do not normally reach the ends of the slots 89 during gripping movement into the cavity 302. At that point, further forward motion of upper gripping piston 82 transfers force to frame member 52U, 52B causing frame 52U to move forward with respect to side plates 62L and 62R with rods 88 of back jaw blocks 87B moving toward jaw block 87F in their respective slots until, as shown in FIG. 8 forward and back jaw blocks 87F, 87B are approximately centrally positioned in cavity 302. After the remotely controlled hydraulic piston 80 is operated, jaws 82 on the forward and back jaw blocks 87F, 87B engage the drill pipe section pin coupling 3P with spring loaded contact pins 87 providing centering and stability of the jaw contact. With the jaws positioned as described above, torquing of the drill pipe section is then accomplished by actuating torque cylinders 45R, 45L until the clockwise position schematically illustrated in FIG. 8 is achieved. Torque forces are transferred from the torque cylinders 45R, 45L to the plates 52 and via slots 89 into the pins 88 of the jaws 87F, 87B. If strengthening is desired, blocks may be welded to the "sandwich" plates 52U, 52B and located along the side plates 66L, 66R to take the torque loads, while leaving the pins 88 only to guide the jaws 87F, 87B and center them when retracted.

Disconnecting of a drill pipe section is accomplished by reversing the steps as described above. The pin coupling 3P is first gripped with the gripping jaws as illustrated in FIG. 8. Next the torquing cylinders 44L, 44R are actuated until a clockwise position is reached as in FIG. 7, where the pin threads of the upper pipe section are "broken loose" from the threads of the lower pipe section. The spinning rollers are operated in a counter-clockwise direction until the upper drill pipe section is unscrewed from the section gripped by the lower wrench 30 of FIG. 5.

Description of Remotely Controlled Manipulator Arm

Figure 13:
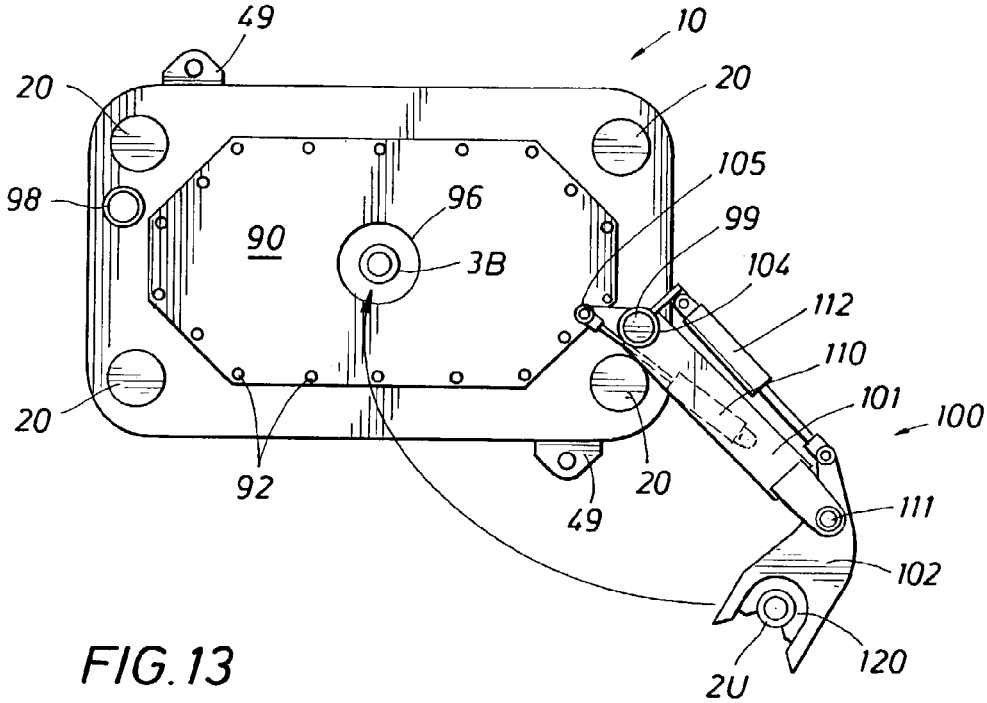
FIG. 13 is a plan view taken along lines 13—13 of FIG. 1 which shows a manipulator arm attached to the top of the wrench assembly for guiding a drill pipe section at the side of the wrench assembly to the well center of the wrench assembly for stabbing into a female box coupling.
Figure 14:
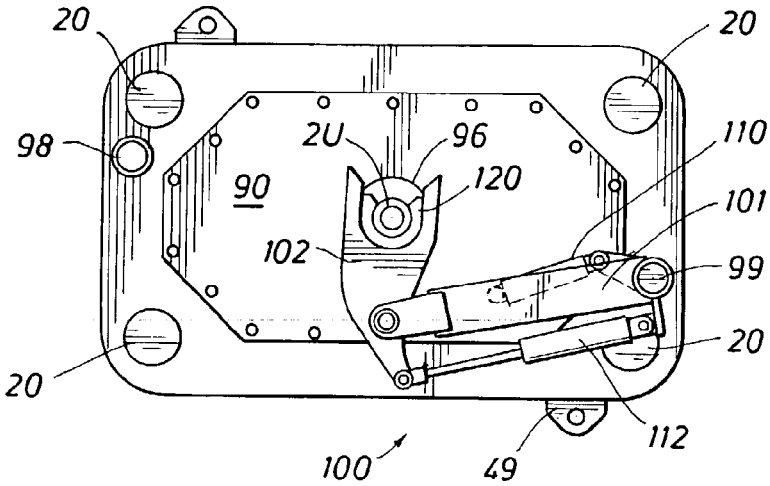
FIG. 14 shows the manipulator arm of FIG. 13 placing a drill pipe section at the center opening of the wrench assembly for stabbing into a female box coupling.

As illustrated in FIG. 1 a manipulator 110 is rotatively mounted on a centering pole or staff 99 on wrench assembly 44. As shown in FIG. 4, centering pole 99 can be installed on opposite longitudinal sides of wrench assembly 40. As illustrated in FIGS. 6 and 13, a pipe manipulator 100 includes an arm 101 to which a hand 102 is pinned at 111. The arm 101 is rotatively mounted on pole 99 with a radial bearing 104 providing radial rotating support. A hydraulic cylinder 110 and rod pinned at 105 provides rotation of arm 110 about pole 99. Hand member 102 is rotatively supported by pin 111, and hydraulic cylinder rotates hand about pin 111. FIG. 13 illustrates hand with an upper drill pipe section 2U supported therein to the sides of the tool 10. FIG. 14 illustrates the arm 101 and hand 102 with the upper drill pipe 2U positioned therein after the remotely controlled cylinders 110, 112 have been operated to center the drill pipe axis in the opening 96. FIG. 13 shows the cover 90 at the top of the wrench assembly with the box coupling of the lower drill pipe 2L section visible through opening 96. FIG. 14 shows the upper drill pipe section 2U centered above the box coupling.

Figure 16:
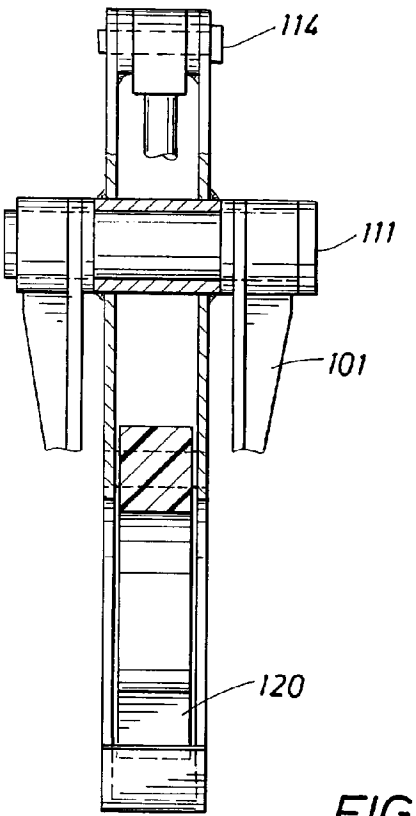
FIGS. 15 and 16 show details of the manipulator hand member of the manipulator arm.
Figure 15:
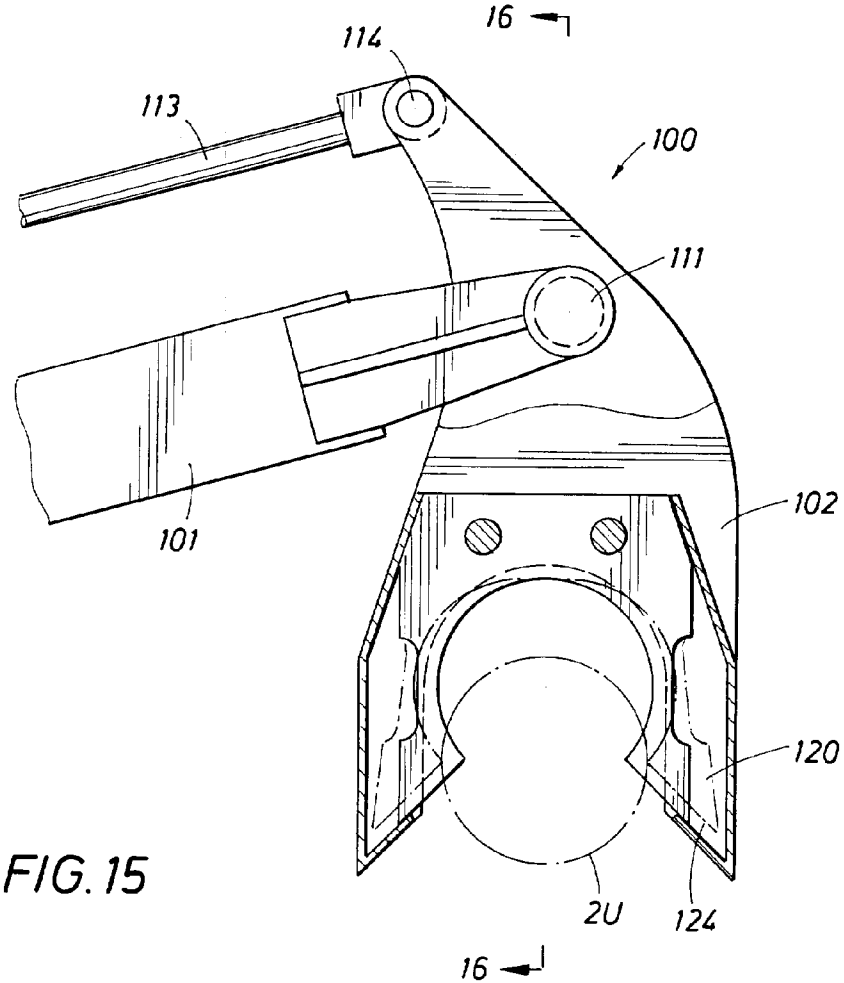

FIGS. 15 and 16 show an enlarged view of the hand 102 with a spring-like insert 120 dimensioned to fit a diameter of drill pipe or other well pipe to be manipulated. The interior of the insert 120 is of a larger diameter than that of the opening of the insert. The insert is preferably fabricated of ultra high molecular weight (UHMW) polyurethane material to provide a spring action to capture a drill pipe section. The insert "fingers" 124 open wider as the drill pipe 20 is pushed radially into the interior of the insert. After a certain radial position is reached, the fingers open wide enough for the pipe section to move completely into the insert whereupon the fingers 124 "snap back" enveloping the pipe while manipulator arm 101 and hand 102 swing the pipe to position for coupling as indicated in FIGS. 1 and 17.

Alternatively the insert 120 can include spring loaded metal fingers or rigid fingers actuated by cylinders in a manner like existing racker system technology.

FIG. 17 illustrates the control circuitry for remote operation of the assembly 10 from control panel 5. Up down control of the wrench assembly is provided with cylinders 20. The lower gripping assembly is activated by actuating pistons 32. The torque cylinders 45R, 45L are actuated in coordination with upper gripping piston 80 for "breaking out" or "torquing up" the threaded connections of the drill pipe as the case may be. The hydraulic spin motors 64 and pin cylinder 60 are coordinated to move the spin rollers of the upper wrench into and out of engagement with the drill pipe for "spinning out" or "spinning in". The hydraulic cylinders 110, 112 of the manipulator 110 are operated to swing the hand 102 in and out of alignment with the well axis.

What is claimed is:

1. Drilling rig apparatus for connecting and disconnecting well pipe comprising, a base fixed for no movement relative to a drilling rig floor spaced about a well opening defining a well axis in the rig floor above a rotary table, said base having a frame with a slot formed therein, a remotely controlled power slip apparatus disposed in said slot for insertion and withdrawal of slips in said rotary table, a remotely controlled lifting mechanism coupled to said base and translatable vertically parallel to said well axis, a powered wrench assembly carried by said lifting mechanism including a lower wrench arranged and designed for gripping a lower box coupling of a drill pipe section at said well opening and an upper wrench arranged and designed for spinning an upper pin coupling into or out of threaded engagement with said box coupling and designed and arranged for gripping and torquing said pin coupling for make up torquing or break out torquing.

2. The drilling rig apparatus of claim 1 further comprising, a manipulator rotatably carried by said powered wrench assembly and having a remotely controlled manipulator arm and hand which pivots between a side of said powered wrench assembly and said well axis.

3. Drilling rig apparatus for connecting and disconnecting well pipe comprising, a base fixed for no movement relative to a drilling rig floor, said base having a supporting frame spaced outwardly about a well axis in the drilling rig floor, a remotely controlled lifting mechanism coupled to said base which translates vertically parallel to said well axis, a remotely controlled powered wrench assembly having a wrench frame carried by said lifting mechanism and positioned to surround said well axis, including a lower wrench carried by said wrench frame and arranged and designed for gripping a lower box coupling of a drill pipe section along said well axis, and an upper wrench carried by said wrench frame and arranged and designed for spinning an upper pin coupling into or out of threaded engagement with said box coupling and designed and arranged for gripping and torquing said pin coupling for make-up torquing or break out torquing to said box coupling, whereby said wrench frame of said powered wrench assembly has no horizontal movement along said drilling rig floor while said base remains fixed during drill pipe section connecting and disconnecting operations.

4. The drilling rig apparatus of claim 3 wherein said powered wrench assembly includes, a horizontal frame member coupled to said lifting mechanism and having a central opening about said well axis, said lower wrench including a plurality of remotely controlled gripping pistons carried by said horizontal frame member, said pistons being disposed perpendicularly to said well axis, said gripping pistons having jaws which face a box coupling of a drill pipe section along said well axis with adjustment of vertical height of said lifting mechanism.

5. The drilling rig apparatus of claim 3 wherein, a said powered wrench assembly is oriented horizontally with respect to said lifting mechanism and has a central opening about said well axis, said upper wrench includes a housing mounted for rotation with respect to said wrench frame member, and said housing has a cavity about said well axis with said cavity characterized by a generally rectangular horizontal cross section with longitudinal and lateral axes, said powered wrench assembly further including, a pair of diametrically opposed horizontal plates mounted for longitudinal translation with respect to said housing, a pair of diametrically opposed spin motor-gear-spin roller assemblies mounted on said pair of horizontal plates with spin rollers of said assemblies facing said cavity, a first remotely controlled powered translation mechanism coupled between said first pair of horizontal plates which is arranged and designed to pull said horizontal plates longitudinally toward said well axis until said spin rollers engage said upper pin coupling in said cavity and to push said horizontal plates away from said well axis such that said spin rollers are out of said cavity, a pair of diametrically opposed jaw blocks mounted for lateral translation with respect to said housing, a pair of jaw teeth mounted on said pair of jaw blocks with said jaw teeth facing said cavity, a second remotely controlled translation mechanism coupled between said pair of jaw blocks which is arranged and designed to push said jaw blocks laterally toward said well axis until said jaw teeth engage and grip said upper pin coupling in said cavity and to pull said jaw blocks away from said well axis such that said jaw blocks are out of said cavity, and a remotely controlled torquing mechanism coupled between said frame and said housing, which is arranged and designed to rotate said housing about said well axis when said jaw teeth grip said upper pin coupling.

6. The apparatus of claim 5 wherein, said wrench frame includes a horizontal frame member coupled to said lifting mechanism and has a central opening about said well axis, and said lower wrench includes a plurality of remotely controlled gripping pistons carried by said horizontal frame member, said pistons being disposed perpendicularly to said well axis, said gripping pistons having jaws which face a box coupling of a drill pipe section along said well axis with adjustment of vertical height of said lifting mechanism.

7. The apparatus of claim 6 further comprising, a manipulator rotatably carried by said powered wrench assembly and having a remotely controlled manipulator arm and hand which pivots between a side of said powered wrench assembly and said well axis.

8. Drilling rig apparatus for connecting and disconnecting well pipe comprising, a base fixed for no movement relative to a drilling rig floor, said base having a supportive frame spaced outwardly about a well opening at the drilling rig floor, said well opening having a generally vertical well axis, a lifting mechanism coupled to said base which is arranged and designed to move vertically parallel to said well axis, a powered wrench assembly carried by said lifting mechanism including a lower wrench arranged and designed for gripping a lower box coupling of a drill pipe section at said well opening and an upper wrench arranged and designed for spinning an upper pin coupling into or out of threaded engagement with said box coupling and designed and arranged for gripping and torquing said pin coupling for make-up torquing or break-out torquing, and a manipulator carried by said powered wrench assembly and having a remotely controlled manipulator arm which pivots between a side of said powered wrench assembly and said well axis.

9. The drilling apparatus of claim 8 further comprising a remotely controlled power slip apparatus cooperatively arranged with said base on said rig floor for insertion and withdrawal of slips in said rotary table.

10. The drilling apparatus of claim 8 further comprising a remotely controlled power slip apparatus cooperatively arranged with said base on said rig floor for insertion and withdrawal of slips in said rotary table.

11. Drilling rig apparatus for connecting and disconnecting well pipe comprising, a base fixed for no movement relative to a drilling rig floor, said base having a supportive frame spaced outwardly about a well opening at the drilling rig floor, said well opening having a generally vertical well axis, a lifting mechanism coupled to said base which is arranged and designed to move vertically parallel to said well axis, a powered wrench assembly carried by said lifting mechanism including a lower wrench arranged and designed for gripping a lower box coupling of a drill pipe section at said well opening and an upper wrench arranged and designed for spinning an upper pin coupling into or out of threaded engagement with said box coupling and designed and arranged for gripping and torquing said pin coupling for make-up torquing or break-out torquing, wherein said base includes supporting feet which contact said drilling rig floor and are designed and arranged to be substantially stationary with respect to said drilling rig floor during drilling rig operations.

12. The drilling apparatus of claim 11 wherein, said supporting feet are placed in a pattern that defines a rectangle, with a foot placed at each corner of said rectangle and with said well axis placed substantially at the center of the rectangle.

13. The drilling apparatus of claim 12 further comprising a horizontal support member connected between each of three pairs of feet and with each support member arranged along respective three sides of said rectangle, with a slot provided between a fourth pair of feet and along a fourth side of said rectangle for placement of a remotely controlled power slip apparatus at said rig floor and around said well axis.

* * * * *